US007241021B2

(12) United States Patent
Hannington

(10) Patent No.: US 7,241,021 B2
(45) Date of Patent: Jul. 10, 2007

(54) EMERGENCY INFORMATION LIGHTING SYSTEM

(75) Inventor: Michael E. Hannington, Madison, OH (US)

(73) Assignee: Avery Dennison Corporation, Pasadena, CA (US)

( * ) Notice: Subject to any disclaimer, the term of this patent is extended or adjusted under 35 U.S.C. 154(b) by 234 days.

(21) Appl. No.: 11/054,812

(22) Filed: Feb. 10, 2005

(65) Prior Publication Data

US 2005/0201079 A1 Sep. 15, 2005

Related U.S. Application Data

(60) Provisional application No. 60/622,241, filed on Oct. 26, 2004, provisional application No. 60/552,475, filed on Mar. 12, 2004.

(51) Int. Cl.
*F21V 9/16* (2006.01)
*F21V 9/04* (2006.01)

(52) U.S. Cl. ..... 362/84; 362/20; 40/570

(58) Field of Classification Search ..... 362/84, 362/812, 20; 40/570, 580, 544
See application file for complete search history.

(56) References Cited

U.S. PATENT DOCUMENTS

| | | | | |
|---|---|---|---|---|
| 2,000,985 | A | 5/1935 | Quinlan et al. | 240/2.25 |
| 2,745,947 | A | 5/1956 | Sansous | 240/6.4 |
| 3,391,068 | A | 7/1968 | McKay | 204/59 |
| 3,391,069 | A | 7/1968 | McKay | 204/59 |
| 3,539,794 | A | 11/1970 | Rauhut et al. | 240/2.25 |
| 3,557,233 | A | 1/1971 | Zweig | 260/668 |
| 3,576,987 | A | 5/1971 | Voight | 240/2.25 |
| 3,597,362 | A | 8/1971 | Bollyky | 252/186 |
| 3,749,679 | A | 7/1973 | Rauhut | 252/188.3 |
| 3,775,336 | A | 11/1973 | Kasulin et al. | 252/188.3 |
| 3,780,462 | A | 12/1973 | Pregel et al. | 40/130 |
| 3,808,414 | A | 4/1974 | Roberts | 240/2.25 |
| 3,888,786 | A | 6/1975 | Maulding | 252/188.3 |
| 3,893,938 | A | 7/1975 | Rauhut | 252/188.3 |
| 3,953,761 | A | 4/1976 | Giudice | 315/71 |
| 3,974,368 | A | 8/1976 | Rauhut | 240/2.25 |
| 4,015,111 | A | 3/1977 | Spector | 240/2.25 |

(Continued)

FOREIGN PATENT DOCUMENTS

| | | |
|---|---|---|
| CN | 2392233 | 8/2000 |

(Continued)

OTHER PUBLICATIONS

U.S. Appl. No. 11/054,874, filed Feb. 10, 2005, Hannington.

(Continued)

*Primary Examiner*—Ali Alavi
(74) *Attorney, Agent, or Firm*—Renner, Otto, Boiselle & Sklar

(57) ABSTRACT

An emergency information lighting system (100/200/300), comprising a primary light source (110/210/310) and a housing (112/212/312) for the primary light source (110/210). The housing (112/212/312) includes a first wall (120/220/320) with indicia openings (126/226/326) which correspond to emergency information. The primary light source (110/210/310) emits primary light, which passes through the indica openings (126/226/326) to display the emergency information to a viewing environment. The housing (112/212) or a bulb (316) incorporates a phosphorescent material (132/232/332) which, in the absence of the primary light, emits passive light to display the emergency information to the viewing environment.

20 Claims, 3 Drawing Sheets

U.S. PATENT DOCUMENTS

| | | | | |
|---|---|---|---|---|
| 4,016,450 | A | 4/1977 | Balekjian | 315/149 |
| 4,184,193 | A | 1/1980 | Heffernan et al. | 362/34 |
| 4,213,115 | A | 7/1980 | Wetzel | 340/47 |
| 4,420,898 | A | 12/1983 | Moses | 40/570 |
| 4,456,126 | A | 6/1984 | Hicks, Jr. | 206/573 |
| 4,466,208 | A | 8/1984 | Logan, Jr. et al. | 40/544 |
| 4,635,166 | A | 1/1987 | Cameron | 362/34 |
| 4,678,608 | A | 7/1987 | Dugliss | 252/700 |
| 4,715,564 | A | 12/1987 | Kinn et al. | 244/153 |
| 4,745,286 | A | 5/1988 | Jones | 250/459.1 |
| 4,748,546 | A | 5/1988 | Ukrainsky | 362/223 |
| 4,768,136 | A | 8/1988 | Tashjian | 362/84 |
| 4,814,949 | A | 3/1989 | Elliott | 362/34 |
| 4,856,219 | A * | 8/1989 | Severance et al. | 43/17.5 |
| 4,903,172 | A | 2/1990 | Schoniger et al. | 362/31 |
| 5,324,202 | A | 6/1994 | Meyers et al. | 434/410 |
| 5,406,463 | A | 4/1995 | Schexnayder, Sr. | 362/34 |
| 5,415,911 | A | 5/1995 | Zampa et al. | 428/40 |
| 5,424,006 | A | 6/1995 | Murayama et al. | 252/301.4 |
| RE35,007 | E | 8/1995 | Cohen et al. | 252/700 |
| 5,564,818 | A | 10/1996 | Grossman et al. | 362/221 |
| 5,654,552 | A | 8/1997 | Toombs | 250/462.1 |
| 5,686,022 | A | 11/1997 | Murayama et al. | 252/351.4 |
| 5,693,394 | A | 12/1997 | Nagai et al. | 428/42.1 |
| 5,695,270 | A | 12/1997 | Collet | 362/34 |
| 5,757,111 | A | 5/1998 | Sato | 313/111 |
| 5,759,671 | A | 6/1998 | Tanaka et al. | 428/166 |
| 5,763,872 | A | 6/1998 | Ness | 250/214 |
| 5,770,111 | A * | 6/1998 | Moriyama et al. | 252/301.4 R |
| 5,775,016 | A * | 7/1998 | Chien | 40/544 |
| 5,833,349 | A | 11/1998 | Apple | 362/84 |
| 5,899,009 | A * | 5/1999 | Fisher | 40/542 |
| 5,913,616 | A | 6/1999 | Galella | 40/542 |
| 6,002,000 | A | 12/1999 | Singh et al. | 544/6 |
| 6,065,847 | A | 5/2000 | Palmer et al. | 362/34 |
| 6,069,440 | A | 5/2000 | Shimizu et al. | 313/486 |
| 6,086,795 | A | 7/2000 | Hatton | 252/582 |
| 6,113,150 | A | 9/2000 | Kinberg | 283/94 |
| 6,120,902 | A | 9/2000 | Van Havenbergh et al. | 428/423.1 |
| 6,126,871 | A | 10/2000 | Cranor | 252/700 |
| 6,130,781 | A | 10/2000 | Gauvin | 359/591 |
| 6,143,514 | A | 11/2000 | Ullman et al. | 435/28 |
| 6,164,782 | A | 12/2000 | Pojar | 359/528 |
| 6,166,856 | A | 12/2000 | Araki et al. | 359/627 |
| 6,206,544 | B1 | 3/2001 | Costa | 362/242 |
| 6,235,148 | B1 | 5/2001 | Courson, Jr. et al. | 156/379.6 |
| 6,267,914 | B1 | 7/2001 | Cranor | 252/700 |
| 6,358,563 | B1 | 3/2002 | Van Duynhoven | 427/282 |
| 6,550,929 | B1 | 4/2003 | Dumas | 362/84 |
| 6,656,566 | B1 | 12/2003 | Kuykendall et al. | 428/138 |
| 6,658,773 | B2 | 12/2003 | Rohne et al. | 40/542 |
| 6,663,255 | B1 | 12/2003 | Carito | 362/34 |
| 6,673,437 | B2 | 1/2004 | Kohla et al. | 428/332 |
| 6,690,103 | B1 | 2/2004 | Uke | 313/344 |
| 2001/0047851 | A1 | 12/2001 | Weidenbach | 160/166.1 |
| 2002/0196628 | A1 | 12/2002 | Yoshida et al. | 362/296 |
| 2003/0167669 | A1 | 9/2003 | Rohne et al. | 40/594 |
| 2003/0196251 | A1 | 10/2003 | Lee | 2/244 |
| 2003/0203211 | A1 | 10/2003 | Wei et al. | 428/412 |
| 2004/0150352 | A1 | 8/2004 | Koide et al. | 315/169.3 |
| 2005/0142371 | A1 * | 6/2005 | Swain et al. | 428/516 |

FOREIGN PATENT DOCUMENTS

| | | |
|---|---|---|
| CN | 1430011 | 7/2003 |
| EP | 293 348 A1 | 4/1988 |
| EP | 522 785 A2 | 7/1992 |
| EP | 1 031 527 A1 | 2/2000 |
| EP | 989 566 A1 | 3/2000 |
| GB | 2 034 503 | 6/1980 |
| GB | 2 196 461 | 4/1988 |
| JP | 61-26634 | 2/1986 |
| JP | 62-218449 | 9/1987 |
| JP | 08030215 | 2/1996 |
| JP | 2000-214781 | 8/2000 |
| JP | 2002-138278 | 5/2002 |
| JP | 2003-201555 | 7/2003 |
| TW | 0476317 | 12/2002 |
| WO | 92/17800 | 10/1992 |
| WO | 93/14943 | 8/1993 |
| WO | 95/32352 | 11/1995 |
| WO | 98/47026 | 10/1998 |
| WO | 03/022951 | 3/2003 |
| WO | 03/054099 | 7/2003 |

OTHER PUBLICATIONS

U.S. Appl. No. 11/055,159, filed Feb. 10, 2005, Hannington.

PCT/US2005/004150; PCT International Search Report mailed Jun. 23, 2005.

PCT/US2005/004109; PCT International Search Report mailed Jun. 3, 2005.

PCT/US2005/004104; PCT international Search Report mailed Nov. 28, 2005.

* cited by examiner

EMERGENCY INFORMATION LIGHTING SYSTEM

RELATED APPLICATIONS

This application claims priority under 35 U.S.C. § 119(e) to U.S. Provisional Patent Application Nos. 60/552,475 and 60/622,241 filed on Mar. 12, 2004 and Oct. 26, 2004, respectively. The entire disclosures of these earlier applications are hereby incorporated by reference.

FIELD OF THE INVENTION

This invention relates generally, as indicated, to an emergency informational lighting system and, more particularly, to a lighting system wherein emergency information is displayed by either primary light or a phosphorescent passive light in the absence of primary light.

BACKGROUND OF THE INVENTION

A common emergency information lighting system comprises a primary light source and a housing for the primary light source. The primary light source has electrically powered lighting components (e.g., filaments, transformer ballast, etc.) and an envelope (i.e., a "bulb") that surrounds these lighting components. The housing typically comprises a series of walls, and a front wall includes indica openings which correspond to emergency information. For example, the openings can spell out the word "EXIT" or show an arrow pointing in an appropriate escape direction. A business office, factory, school, or other public building can have dozens and sometimes even hundreds of such emergency information lighting systems.

When the primary light source is illuminated, the primary light shines through the indicia openings, thereby displaying the emergency information. However, when the primary light source is not illuminated because its power supply is interrupted, the information will not be visible. In this situation, supplemental power can be provided via a battery or secondary electric source (e.g., an on-premise emergency generator) so that the emergency information will remain visible during emergency conditions.

SUMMARY OF THE INVENTION

The present invention provides an emergency information lighting system, wherein components of a conventional system (e.g., housing walls or a bulb envelope) incorporate a phosphorescent material so that emergency information remains visible during emergency conditions.

More particularly, the present invention provides an emergency information lighting system comprising a primary light source and a housing for the primary light source. The housing includes a first wall with indicia openings which correspond to the emergency information. The primary light source emits primary light, which passes through the indica openings to display the emergency information to a viewing environment.

The housing can incorporate a phosphorescent material which, in the absence of the primary light, emits passive light to display the emergency information to the viewing environment. For example, the front wall of the housing can incorporate the phosphorescent material, or rear/side walls of the housing can incorporate the phosphorescent material. The phosphorescent particles can be coated on the exterior surface of the front wall or can be coated on the interior surface(s) of the rear/side wall(s) or, instead, phosphorescent particles can be embedded within the molded polymer of the walls.

Alternatively, the envelope (i.e., the "bulb") for the primary light source can incorporate a phosphorescent material which, in the absence of the primary light, emits passive light to display the emergency information to the viewing environment. For example, phosphorescent particles can be coated on the bulb or embedded therein. The entire bulb can be coated/embedded with the phosphorescent particles or only those areas offset from the direction of the primary light.

These and other features of the invention are fully described and particularly pointed out in the claims. The following description and drawings set forth in detail certain illustrative embodiments of the invention, which are indicative of but a few of the various ways in which the principles of the invention may be employed.

DRAWINGS

DETAILED DESCRIPTION

Figure 1A:
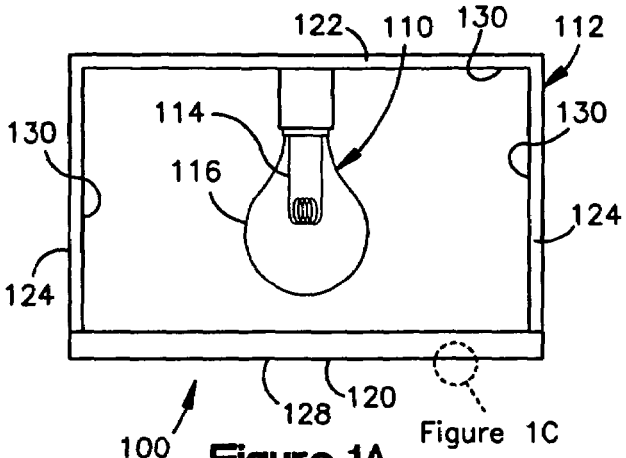
FIG. 1A is a side view, partly in section, of an emergency information lighting system 100 according to the present invention.

Referring now to the drawings, and initially to FIG. 1A, a lighting system 100 according to the present invention is shown. The lighting system 100 includes a primary light source 110 and a housing 112 for the primary light source 110. The primary light source 110 comprises lighting components 114 that are electrically powered. For example, if the primary light source 110 is an incandescent light bulb, the electrical components 114 can comprise a filament electrically connected to the power source. If the lighting system 110 includes a fluorescent light bulb, the electrical components 114 can comprise a transformer ballast electrically connected to the power source and a fluorescent tube. In either or any event, the primary light source 110 additionally comprises a glass or plastic envelope 116 (i.e., a "bulb") that surrounds the lighting components 114.

Figure 1B:
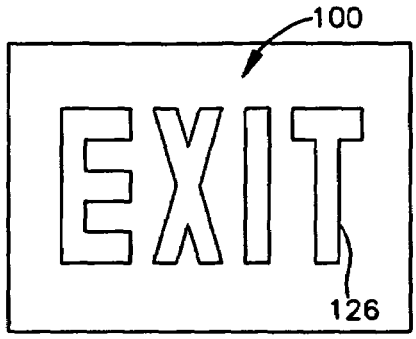
FIG. 1B is a front view of the emergency information lighting system 100.

The housing 112 comprises a front wall 120, a rear wall 122, and side walls 124, these modifiers corresponding to the direction in which primary light is emitted by the primary light source 110. As is best seen by referring additionally to FIG. 1B, the front wall 120 includes indica openings 126 which correspond to emergency information which, in the illustrated embodiment, is the word "EXIT." Other examples of emergency information could include, for example, an arrow pointing in an appropriate escape direction.

Figure 1C:
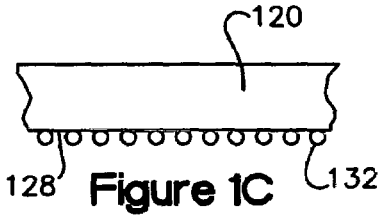
FIG. 1C is a close-up view of a wall of the emergency lighting system 100.
Figure 1D:
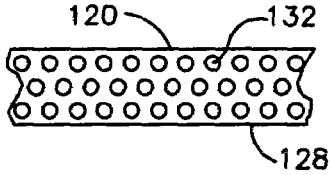
FIG. 1D is a close-up view of another version of the wall of the emergency lighting system 100.

The front wall 120 of the housing 112 incorporates a phosphorescent material 132 which absorbs and stores light radiated thereupon and, in the absence of ambient or artificial light, will emit phosphorescence to provide passive lighting. The phosphorescent particles 132 can be coated on the exterior surface 128 of the wall 120 as shown in FIG. 1C. Alternatively, the phosphorescent particles 132 can be embedded within the wall 120 as shown in FIG. 1D. For example, if the housing 112 and/or wall 120 is made by a molding process, the particles 132 could be introduced into the to-be-molded composition (e.g., a polymer) prior to molding, curing, and/or setting.

Figure 1E:
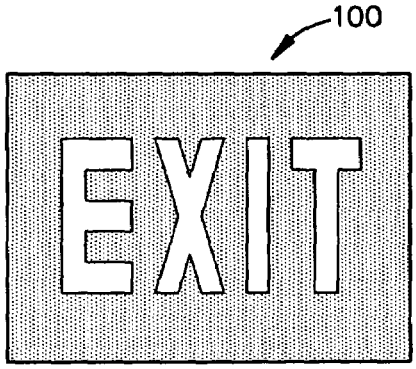
FIG. 1E is a schematic view of the emergency lighting system 100 during primary lighting conditions.
Figure 1F:
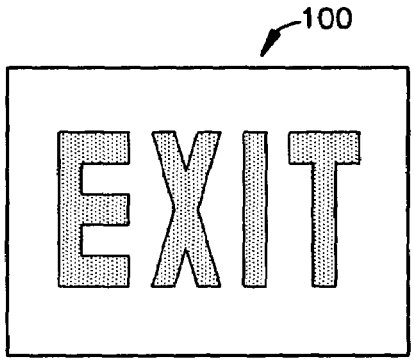
FIG. 1F is a schematic view of the emergency lighting system 100 during passive lighting conditions.

During normal (e.g., non-emergency) conditions, the primary light source 110 will emit primary light, which passes through the indica openings 126 to display the emergency information to a viewing environment. In this case, the indicia openings 126 will be illuminated and the surrounding front wall 120 will be dark compared to the remaining areas, as shown in FIG. 1E. In the absence of the primary light, and in dark conditions, the phosphorescent material 132 emits passive light to display the emergency information to the viewing environment. In this case, the indicia openings 126 will be dark and the surrounding front wall will be illuminated compared to the remaining areas as shown in FIG. 1F.

Figure 2A:
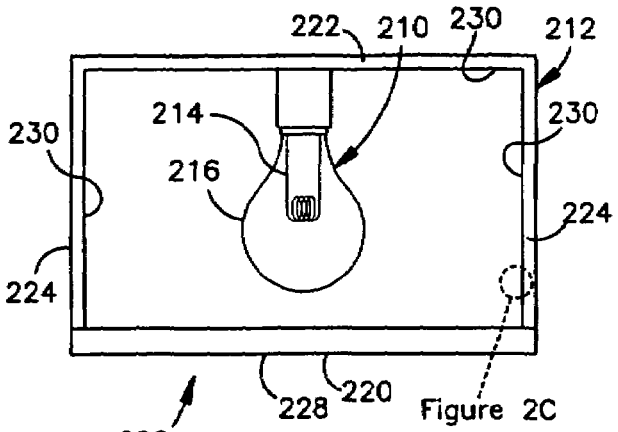
FIG. 2A is a side view, partly in section, of an emergency information lighting system 200 according to the present invention.
Figure 2B:
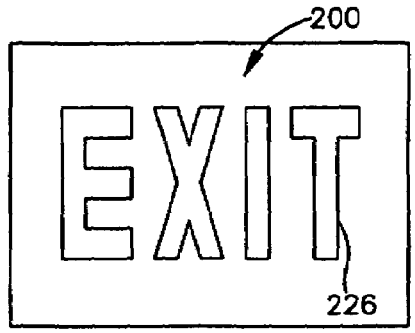
FIG. 2B is a front view of the emergency information lighting system 200.

Referring now to FIG. 2A, a lighting system 200 according to the present invention is shown. The lighting system 200 includes a primary light source 210 (with lighting components 214 and an envelope 216) and a housing 212 (with walls 220, 222, and 224) for the primary light source 210. As shown in FIG. 2B, the front wall 220 includes indica openings 226 which correspond to emergency information.

Figure 2C:
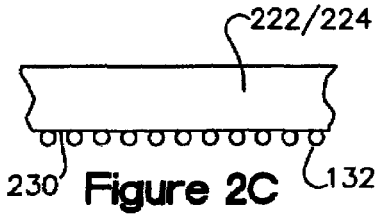
FIG. 2C is a close-up view of a wall of the emergency lighting system 200.
Figure 2D:
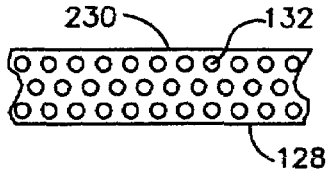
FIG. 2D is a close-up view of another version of the wall of the emergency lighting system 200.

The side wall 224 and/or the rear wall 226 of the housing 212 incorporate a phosphorescent material 232 which absorbs and stores light radiated thereupon and, in the absence of ambient or artificial light, will emit phosphorescence to provide passive lighting. The phosphorescent particles 232 can be coated on the interior surface 230 of the wall 222/224 as shown in FIG. 2C, or embedded within the wall 222/224 as shown in FIG. 2D.

Figure 2E:
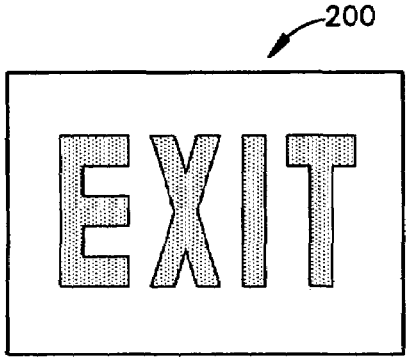
FIG. 2E is a schematic view of the emergency lighting system 200 during primary lighting conditions.
Figure 2F:
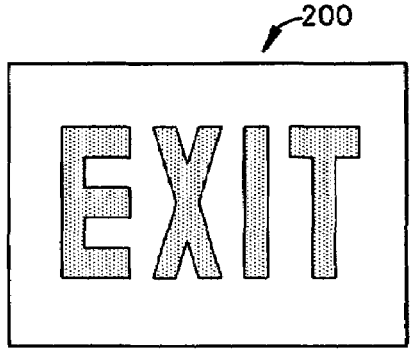
FIG. 2F is a schematic view of the emergency lighting system 200 during passive lighting conditions.

During normal (e.g., non-emergency) conditions, the primary light source 210 will emit primary light, which passes through the indica openings 226 to display the emergency information to a viewing environment. (FIG. 2E.) In the absence of the primary light, and in dark conditions, the phosphorescent material 232 emits passive light to display the emergency information to the viewing environment. (FIG. 2F.) In either case, the indicia openings 226 will be illuminated and the surrounding front wall 220 will be dark.

Figure 3A:
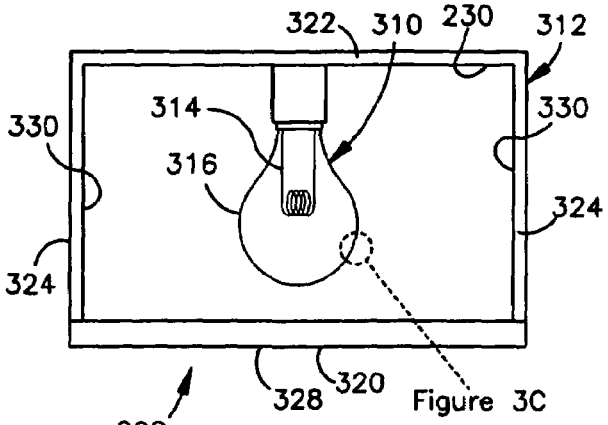
FIG. 3A is a side view, partly in section, of an emergency information lighting system 300 according to the present invention.
Figure 3B:
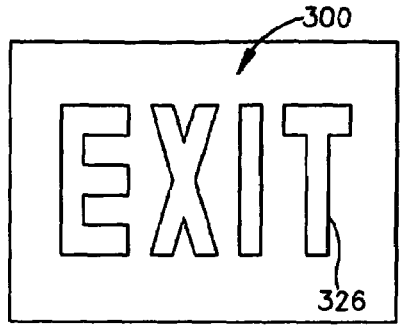
FIG. 3B is a front view of the emergency information lighting system 300.

Referring now to FIG. 3A, a lighting system 300 according to the present invention is shown. The lighting system 300 includes a primary light source 310 (with lighting components 314 and an envelope 316) and a housing 312 (with walls 320, 323, and 324) for the primary light source 310. As shown in FIG. 3B, the front wall 320 includes indica openings 326 which correspond to emergency information.

Figure 3C:
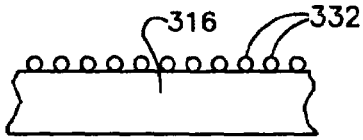
FIG. 3C is a close-up view of a bulb of the emergency lighting system 300.
Figure 3D:
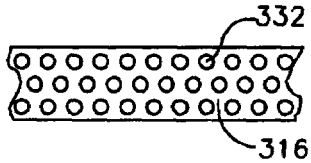
FIG. 3D is a close-up view of another version of the bulb of the emergency lighting system 300.
Figure 3E:
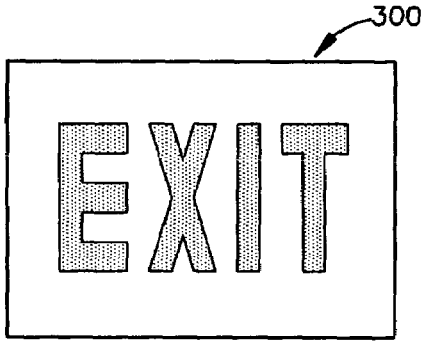
FIG. 3E is a schematic view of the emergency lighting system 300 during primary lighting conditions.
Figure 3F:
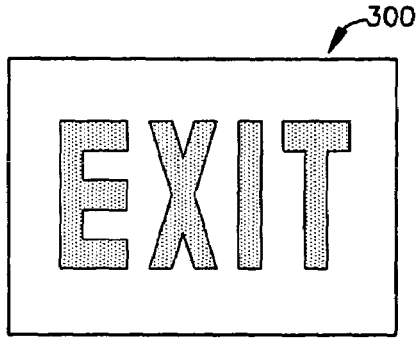
FIG. 3F is a schematic view of the emergency lighting system 300 during passive lighting conditions.
Figure 3G:
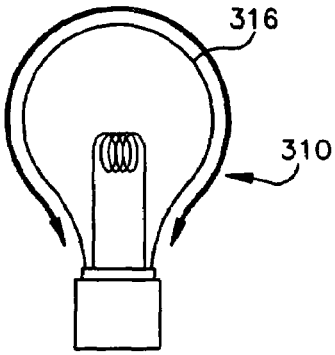
FIG. 3G is an enlarged view of the bulb of the lighting system 300, schematically showing the coverage of the phosphorescent material.
Figure 3H:
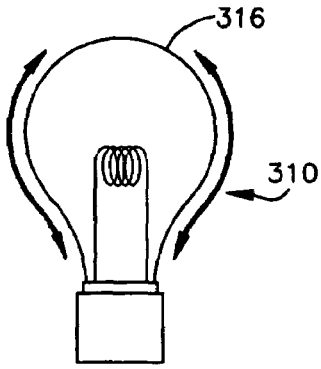
FIG. 3H is an enlarged view of the bulb of the lighting system 300, schematically showing the coverage of the phosphorescent material.

The envelope 316 (e.g., bulb) incorporates a phosphorescent material 332 which absorbs and stores light radiated thereupon and, in the absence of ambient or artificial light, will emit phosphorescence to provide passive lighting. The phosphorescent particles 332 can be coated on the surface of the envelope 316 as shown in FIG. 3C, or embedded with the envelope 316 as shown in FIG. 3D. The coating and/or embedding can encompass the entire surface area of the envelope 316 (FIG. 3G) or can be concentrated in the areas offset from the emission direction of the primary light (FIG. 3H).

During normal (e.g., non-emergency) conditions, the primary light source 310 will emit primary light, which passes through the indica openings 326 to display the emergency information to a viewing environment. (FIG. 3E.) In the absence of the primary light, and in dark conditions, the phosphorescent material 332 emits passive light to display the emergency information to the viewing environment. (FIG. 3F.) In either case, the indicia openings 326 will be illuminated and the surrounding front wall 320 will be dark.

The phosphorescent material 132/232/332 can be chosen to provide an emission of at least 15.0 mcd/$m^2$ at ten minutes and at least 2 mcd/$m^2$ at sixty minutes and/or an emission of at least 20.0 mcd/$m^2$ at ten minutes and at least 2.8 mcd/$m^2$ at sixty minutes. These emission levels are necessary to satisfy IMO and ASTM standards, respectfully, for emergency lighting requirements. Preferably, the phosphorescent material 132/232/332 can have an emission of at least 30 mcd/$m^2$ at ten minutes, at least 40 mcd/$m^2$ at ten minutes, and/or at least 50 mcd/$m^2$ at ten minutes. The phosphorescent material 132/232/332 can include materials having different levels of phosphorescence.

The phosphorescent material 132/232/332 can be a phosphorescent phosphor including a matrix expressed by $MAl_2O_4$ in which M is calcium, strontium, or barium, or in which M is magnesium activated by calcium, strontium, barium, and/or europium. These phosphorescent phosphors show excellent photo-resistance and possess extremely long afterglow characteristics. Such phosphorescent phosphors are disclosed and described in U.S. Pat. No. 5,424,006, the entire disclosure of which is hereby incorporated by reference. Another phosphor having intense and persistent afterglow characteristics is disclosed in U.S. Pat. No. 5,770,111, the entire disclosure of which is also hereby incorporated by reference.

With particular reference to the lighting system 300, the phosphorescent material 132/232/332 should be such that an acceptable optical transmittance is provided so that primary light from the primary light source 310 can be transmitted through the envelope 316 to the viewing environment. For example, the coated and/or embedded bulb 316 could have an optical transmittance of at least 50%, at least 60%, at least 70%, at least 80%, and/or at least 90%. By using the intense and/or persistent phosphors described above, a low density can be used when coating the envelope 316 and/or when incorporating the phosphors therein. This low density corresponds to a high transmission, whereby high (or at least acceptable) emissions are accomplished without overly compromising transmission.

One may now appreciate that the present invention an emergency information lighting system 100/200/300 wherein components of a conventional system (e.g., housing walls 120/222/224 or a bulb envelope 316) incorporate a phosphorescent material 132/232/332 so that emergency information remains visible during emergency conditions. Although the invention has been shown and described with respect to certain preferred embodiments, it is evident that equivalent and obvious alterations and modifications will occur to others skilled in the art upon the reading and understanding of this specification. The present invention includes all such alterations and modifications and is limited only by the scope of the following claims.

The invention claimed is:

1. An emergency information lighting system, comprising a primary light source and a housing for the primary light source;

the housing including a front wall, a rear wall, and side wall(s), the front, rear, and side corresponding to the direction in which primary light is emitted by the primary light source;

the front wall having indicia openings which correspond to emergency information;

the primary light source emitting primary light, which passes through said indica openings to display said emergency information to a viewing environment;

the front wall, the rear wall, and/or the side wall(s) incorporating a phosphorescent material which, in the absence of the primary light, emits passive light to display said emergency information to the viewing environment.

2. An emergency information lighting system as set forth in claim 1, wherein the rear wall and/or the side wall(s) have interior surfaces surrounding the primary light source and wherein these interior surfaces incorporate the phosphorescent material, whereby:

when the primary light passes through the indicia openings, the emergency information will be lighted and the first wall will be dark; and when the passive light is emitted, it will pass through the indicia openings and the emergency information will be lighted and the first wall will be dark.

3. An emergency lighting system as set forth in claim 1, wherein the phosphorescent material provides an emission of at least 15.0 mcd/m$^2$ at ten minutes and at least 2 mcd/m$^2$ at sixty minutes.

4. An emergency lighting system as set forth in claim 1, wherein the phosphorescent material provides an emission of at least 20.0 mcd/m$^2$ at ten minutes and at least 2.8 mcd/m$^2$ at sixty minutes.

5. An emergency lighting system as set forth in claim 1, wherein the phosphorescent material provides an emission of at least 30.0 mcd/m$^2$ at ten minutes.

6. An emergency information lighting system as set forth in claim 1, wherein the primary light source is electrically powered.

7. An emergency information lighting system comprising a primary light source and a housing for the primary light source;

the housing including a first wall with indicia openings which correspond to emergency information;

the primary light source emitting primary light, which passes through said indica openings to display said emergency information to a viewing environment;

the housing incorporating a phosphorescent material which, in the absence of the primary light, emits passive light to display said emergency information to the viewing environment;

wherein an exterior surface of the first wall with the indicia openings incorporates the phosphorescent material, whereby:

when the primary light passes through the indicia openings, the emergency information will be lighted and the first wall will be dark; and when the passive light is emitted, the emergency information will be dark and the first wall will be lighted.

8. An emergency lighting system as set forth in claim 7, wherein the phosphorescent material comprises phosphorescent particles embedded within the first wall.

9. An emergency lighting system as set forth in claim 7, wherein the phosphorescent material is coated on the first wall of the housing.

10. An emergency lighting system as set forth in claim 7, wherein the phosphorescent material provides an emission of at least 15.0 mcd/m$^2$ at ten minutes and at least 2 mcd/m$^2$ at sixty minutes.

11. An emergency lighting system as set forth in claim 7, wherein the phosphorescent material provides an emission of at least 20.0 mcd/m$^2$ at ten minutes and at least 2.8 mcd/m$^2$ at sixty minutes.

12. An emergency lighting system as set forth in claim 7, wherein the phosphorescent material provides an emission of at least 30.0 mcd/m$^2$ at ten minutes.

13. An emergency information lighting system, comprising a primary light source and a housing for the primary light source;

the primary light source including lighting components and a bulb which envelopes the lighting components;

the housing including a first wall with indicia openings which correspond to emergency information;

the primary light source emitting primary light, which passes through the indica openings to display the emergency information to a viewing environment;

the bulb incorporating a phosphorescent material which, in the absence of the primary light, emits passive light that passes through the indicia openings to display the emergency information to the viewing environment.

14. An emergency information lighting system as set forth in claim 13, wherein the bulb has an optical transmittance of at least 50%.

15. An emergency lighting system as set forth in claim 13, wherein the phosphorescent material provides an emission of at least 40.0 mcd/m$^2$ at ten minutes.

16. An emergency lighting system as set forth in claim 13, wherein the phosphorescent material provides an emission of at least 50.0 mcd/m$^2$ at ten minutes.

17. An emergency information lighting system as set forth in claim 13, wherein the primary light source is electrically powered.

18. An emergency lighting system as set forth in claim 13, wherein the phosphorescent material provides an emission of at least 15.0 mcd/m$^2$ at ten minutes and at least 2 mcd/m$^2$ at sixty minutes.

19. An emergency lighting system as set forth in claim 13, wherein the phosphorescent material provides an emission of at least 20.0 mcd/m$^2$ at ten minutes and at least 2.8 mcd/m$^2$ at sixty minutes.

20. An emergency lighting system as set forth in claim 13, wherein the phosphorescent material provides an emission of at least 30.0 mcd/m$^2$ at ten minutes.

* * * * *